US010125339B1

(12) United States Patent
Sauer et al.

(10) Patent No.: US 10,125,339 B1
(45) Date of Patent: Nov. 13, 2018

(54) COMPOSITION OF FLUID FOR IMPREGNATION IN DISPOSABLE WIPES FOR CLEANING INDOOR ATHLETIC SHOES THAT DOES NOT DAMAGE INDOOR FLOORING

(71) Applicant: Grip N' Go Wipes, LLC, Thousand Oaks, CA (US)

(72) Inventors: Keegan Sauer, Thousand Oaks, CA (US); Denia Dy, Riverside, CA (US); Craig Henderson, Fontana, CA (US)

( * ) Notice: Subject to any disclaimer, the term of this patent is extended or adjusted under 35 U.S.C. 154(b) by 40 days.

(21) Appl. No.: 15/456,923

(22) Filed: Mar. 13, 2017

Related U.S. Application Data

(60) Provisional application No. 62/349,833, filed on Jun. 14, 2016.

(51) Int. Cl.

| | |
|---|---|
| ***C11D 3/18*** | (2006.01) |
| ***C11D 3/382*** | (2006.01) |
| ***C11D 3/36*** | (2006.01) |
| ***C11D 3/20*** | (2006.01) |
| ***C11D 3/37*** | (2006.01) |
| ***C11D 3/22*** | (2006.01) |
| ***C11D 3/50*** | (2006.01) |

(52) U.S. Cl.
CPC ..... *C11D 3/181* (2013.01); *C11D 3/2044* (2013.01); *C11D 3/2048* (2013.01); *C11D 3/2068* (2013.01); *C11D 3/2086* (2013.01); *C11D 3/221* (2013.01); *C11D 3/362* (2013.01); *C11D 3/3707* (2013.01); *C11D 3/382* (2013.01); *C11D 3/50* (2013.01)

(58) Field of Classification Search
CPC ..... C11D 1/662; C11D 3/181; C11D 3/382; C11D 3/2044; C11D 3/2068; C11D 3/2086; C11D 3/3707; C11D 3/2048; C11D 3/221; C11D 3/50
USPC ..... 510/119, 130, 136, 137, 138, 438, 470, 510/488, 505, 506
See application file for complete search history.

(56) References Cited

U.S. PATENT DOCUMENTS

| | | | |
|---|---|---|---|
| 6,753,063 | B1 | 6/2004 | Pung et al. |
| 8,715,422 | B2 | 5/2014 | Leslie |
| 8,966,701 | B2 | 3/2015 | Dellcave et al. |
| 9,023,374 | B2 | 5/2015 | Touitou |
| 9,032,583 | B2 | 5/2015 | McLaughlin et al. |
| 2012/0039974 | A1 | 2/2012 | Napolitano et al. |
| 2015/0320292 | A1 | 11/2015 | McLaughlin et al. |
| 2015/0342862 | A1 | 12/2015 | Hammer |

*Primary Examiner* — Gregory R Delcotto
(74) *Attorney, Agent, or Firm* — Sandy Lipkin

(57) ABSTRACT

A composition of matter for impregnation into disposable wipes for use on athletic indoor shoes such as volleyball or basketball shoes that is quick, drying, made from natural ingredients, is gentle on human skin and that does not erode the sole of shoe or damage the protective coating on indoor athletic courts. The composition uses the unique choice of an undecane/tridecane blend combined with specific percentages of water, natural surfactants, natural oils and natural based light volatile alkane hydrocarbon blend that combined cleans rubber soles, is quick drying and has low interaction with flooring when shoes are worn on an athletic court.

1 Claim, No Drawings

COMPOSITION OF FLUID FOR IMPREGNATION IN DISPOSABLE WIPES FOR CLEANING INDOOR ATHLETIC SHOES THAT DOES NOT DAMAGE INDOOR FLOORING

REFERENCE TO PRIOR APPLICATION

This application claims priority of the provisional patent application 62/349,833, filed Jun. 14, 2016 entitled COMPOSITION OF FLUID FOR IMPREGNATION IN DISPOSABLE WIPES FOR CLEANING INDOOR ATHLETIC SHOES THAT DO NOT DAMAGE INDOOR FLOORING by Keegan Sauer.

BACKGROUND OF THE INVENTION

Field of the Invention

The present invention relates to the field of solutions for cleaning articles of clothing and particularly toward a solution that is to be impregnated into disposable wipes for cleaning the bottoms of indoor athletic shoes that is quick drying, gentle on skin and does not build up on the floor or do damage to the flooring.

Description of the Prior Art

In indoor sports such as volleyball and basketball, the athletes wear specialized shoes for higher performance. In this indoor setting, the performance takes place on hardwood flooring and/or linoleum that has its own specialized protective coating to allow for ease in moving around the floor. During the course of the athletic games and/or practices, the shoes get dirty and worn which leads to decreased grip on the flooring and poorer performance. Since the flooring has a protective coating, it is important to not introduce any chemicals to the flooring that will damage the protective coating.

Prior art includes formulations for wipes such as U.S. Pat. Pub. No. 2015/0342862 to Hammer provides wipes that are gentle on skin and are generally formulated with the aim of cosmetic use. There does exist in the art wipes that are used for cleaning shoes that is gentle on skin and that does not harm indoor flooring as these formulations are made primarily in a cosmetic context and not an industrial or household context.

It is the object of the instant invention to provide a composition of matter that is in a solution that is impregnated into disposable wipes that allow for easy and quick cleaning of the shoes during use, while not damaging the protective coating on the flooring nor the shoes themselves and at the same time being non-irritating to human skin.

It is a further object of the instant invention that the solution be quick-drying and made from organic and natural ingredients.

SUMMARY OF THE INVENTION

The basic embodiment of the present invention teaches a composition of matter to be impregnated into individual wiping cloths for the cleaning of the soles of athletic shoes that do not damage the soles of the athletic shoes or the protective flooring in indoor sports arenas that is non-irritating to human skin comprising: 88-93% water; 1-3% sucrose cocoate; 1-3% polyglyceryl-3 polyricinoleate; 1-3% undecane; 0.5-1% tridecane; 0.5-1% sodium lauryl glucose carboxylate; 0.5-1% phenoxyethanol; 0.1-0.5% *melaleuca alternifolia* (tea tree) leaf oil; 0.1-0.5% *lavandula angustifolia* (lavender) oil; 0.1-0.5% citrus *aurantium dulcis* (orange) peel oil; 0.1-0.5% phytic acid; 0.1-0.5% lauryl glucoside; 0.1-0.5% caprylyl glycol; 0.1-0.5% ethylhexylglycerin; 0.1-0.5% hexylene glycol; less than 0.01% citric acid.

DETAILED DESCRIPTION OF A PREFERRED EMBODIMENT

In the preferred embodiment, a composition of matter is produced and impregnated into standard material used for disposable wipes. The wipes can then be housed in a convenient, mobile container such as a cylinder or box wherein the wipes are kept moist in the solution and easily at hand for use.

The primary inventive focus of the composition is to provide a formulation that does not harm the treated floors of indoor athletic courts. The unique formulation utilizes a combination of undecane and tridecane with a specific concentration of water, combined with natural surfactants, natural oils and a natural based light volatile alkane hydrocarbon blend. The formulation is an improvement to typical cosmetic mild skin cleansing blends and a typical cosmetic face wash is used as a base.

By starting with a base of a typical cosmetic face wash blend, the composition will remain gentle on human skin. In order to make the composition usable as a shoe cleaner that does not damage indoor flooring, constituents were added that are typically not found in cosmetic use, but more in the industrial/household use. The inclusion of specific undecane/tridecane mixture aids in speeding drying dry time, helps with shoe tack and provides conditioning to the rubber soles. The solution is organic coming from natural sources that include terpenes that are included for additional conditioning, cleaning and fragrance. Prior art cosmetic formulations are incapable of providing these industrial features.

The unique choice of undecane/tridecane combined with percentages of water, natural surfactants, natural oils and natural based light volatile alkane hydrocarbon blend cleans rubber is not only quick drying, but more importantly has the required low interaction with flooring when shoes are worn on the court. Furthermore, the composition does not degrade the rubber on the soles of the shoes in such a way as to add to much tack to the shoes, providing too much grip on the floor and potentially being a source of injury.

Example Formulation:

88-93% water;
1-3% sucrose cocoate;
1-3% polyglyceryl-3 polyricinoleate;
1-3% undecane;
0.5-1% tridecane;
0.5-1% sodium lauryl glucose carboxylate;
0.5-1% phenoxyethanol;
0.1-0.5% *melaleuca alternifolia* (tea tree) leaf oil;
0.1-0.5% *lavandula angustifolia* (lavender) oil;
0.1-0.5% citrus *aurantium dulcis* (orange) peel oil;
0.1-0.5% phytic acid;
0.1-0.5% lauryl glucoside;
0.1-0.5% caprylyl glycol;
0.1-0.5% ethylhexylglycerin;
0.1-0.5% hexylene glycol;
less than 0.01% citric acid.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A composition of matter to be impregnated into individual wiping cloths for the cleaning of the soles of athletic shoes that do not damage the soles of the athletic shoes or the protective flooring in indoor sports arenas that is non-irritating to human skin comprising:

88-93% water;
1-3% sucrose cocoate;
1-3% polyglyceryl-3 polyricinoleate;
1-3% undecane;
0.5-1% tridecane;
0.5-1% sodium lauryl glucose carboxylate;
0.5-1% phenoxyethanol;
0.1-0.5% *melaleuca alternifolia* (tea tree) leaf oil;
0.1-0.5% *lavandula angustifolia* (lavender) oil;
0.1-0.5% citrus *aurantium dulcis* (orange) peel oil;
0.1-0.5% phytic acid;
0.1-0.5% lauryl glucoside;
0.1-0.5% caprylyl glycol;
0.1-0.5% ethylhexylglycerin;
0.1-0.5% hexylene glycol;
less than 0.01% citric acid.

* * * * *